United States Patent [19]

Carbonneau

[11] 4,035,591

[45] July 12, 1977

[54] ELECTROACOUSTIC TRANSDUCERS

[75] Inventor: Gordon S. Carbonneau, Grand Rapids, Mich.

[73] Assignee: Carbonneau Industries, Inc., Grand Rapids, Mich.

[21] Appl. No.: 666,191

[22] Filed: Mar. 12, 1976

[51] Int. Cl.[2] ..... H04R 9/02

[52] U.S. Cl. ..... 179/119 R; 335/231

[58] Field of Search ..... 179/115.5 R, 117, 119 R, 179/120; 335/231

[56] References Cited

FOREIGN PATENT DOCUMENTS

| | | | |
|---|---|---|---|
| 106,158 | 1/1963 | Czechoslovakia | 335/231 |
| 1,468,916 | 1/1967 | France | 179/115.5 R |
| 386,732 | 1/1933 | United Kingdom | 179/117 |

*Primary Examiner*—George G. Stellar
*Attorney, Agent, or Firm*—McGarry & Waters

[57] ABSTRACT

An electroacoustic transducer includes a permanent annular magnet with a central aperture, with front and back multisided flux plates attached to the annular magnet to complete a magnetic circuit which drives a voice coil and operatively drives a diaphragm. The edges of the front and back multisided fluxed plates defined a surface area of approximately 77 percent of the area bounded by the outer diameter of annular magnet.

11 Claims, 6 Drawing Figures

ELECTROACOUSTIC TRANSDUCERS

BACKGROUND OF THE INVENTION

1. Field of the Invention

This invention relates to an electroacoustic transducer and more particularly to an electroacoustic transducer that has multisided flux plates used in connection with a differently shaped permanent magnet.

2. Description of the Prior Art

Ceramic or ferrite electroacoustic transducers, commonly known as loud speakers, have front and back flux plates, an annular magnet, a pole piece and a voice coil operatively connected to a diaphragm.

Conventionally, the front and back flux plates of an electroacoustic transducer are slightly smaller in contour shape and area than the magnet placed in between the two flux plates, and have the same contour shape as the magnet with the edges of the flux plates placed parallel to the edges of the magnet. The magnet and the flux plates have most commonly been circular in shape due to a high magnetic efficiency of the circular contour in maintaining a magnetic circuit.

An example of an electroacoustic transducer is disclosed in French patent to Audax, Brevet d'Invention No. 1,468,916 issued Jan. 2, 1967. In the Audax patent, a round front flux plate has a plurality of notches which correspond to projections in a collar in the rear face of the basket. The notches are placed in the front flux plate for attaching the yoke to the basket. The front flux plate is inserted through the collar and the yoke is twisted, locking the yoke into the collar. Another embodiment of the Audax reference discloses a tapered neck around the circular front pole piece with broad flattened notches formed on the neck. The pole piece then fits through a corresponding shaped collar in a basket and, when twisted, is locked to the collar. In the Audax reference, even though the flux plate has notches, the notches are placed away from the permanent magnet. Consequently, the surface of the flux plate which abuts the permanent magnet has the same contour shape as the permanent magnet.

In the loud speaker art, square flux plates with square magnets that have radial corners are also known. Except for the radial corner, the contour of the square flux plate is parallel to the edges of the square magnet. For all other shapes, the edges of the flux plate have always been placed parallel to the edges of the permanent magnet.

SUMMARY OF THE INVENTION

This invention relates to electroacoustic transducers commonly known as loudspeakers where the edges of the flux plates are not congruent with the edges of the permanent magnet. More particularly, this invention relates to an electroacoustic transducer with multisided flux plates which attach to both sides of an annular permanent magnet. The multisided flux plate has two faces and a plurality of sides wherein each side has an edge abutting the annular magnet.

The annular permanent magnet has a central aperture which is aligned with a central aperture of a front multisided flux plate. The front multisided flux plate is attached to the front surface of the annular magnet. A back multisided flux plate is attached to the back side of the annular permanent magnet. A pole piece is attached to the center of the back multisided flux plate and extends through the central apertures of the permanent and the front flux plate. The pole piece is narrow enough to leave an air gap between itself and the annular magnet and front flux plate. The structure described sets up a magnetic circuit with a magnetic field extending throughout the air gap. A voice coil, capable of carrying current, fits in the air gap and is capable of coaxial movement in regard to the axis of the pole piece. When current varies in the voice coil, the magnetic field will change its effective force on the coil and cause it to move in the coaxial direction. Preferably, the invention has the voice coil operatively connected to a speaker diaphragm and a cone attached to the front surface of the front flux plate. The outer end of the diaphragm is attached to an outer rim of a metal speaker housing.

The multisided flux plate is a flat relatively thin piece of magnetically conductive material. The flux plate has at least five edges, preferably eight. The flux plate is large enough to effectively conduct and route the magnetic field caused by the annular magnet. In order to effectively do this, the area bounded by sides of the flux plate is at least 70 percent of the area bounded by the outer diameter of the annular magnet, preferably being large enough to cover 77 percent of the area bounded by the outer diameter of the annular magnet.

The multisided flux plate is more economical than circular flux plates because the manufacturing process produces less wasted materials on the stamped sheets from which the multisided flux plates are pressed. When circular flux plates are stamped from sheets, the sheets must be wider than the diameter of the flux plates. At each edge of the sheet, an extra margin in the distance equal to the thickness of the sheet is needed. Hence, the width of the sheet is wider than the diameter of the flux plate by twice the thickness of the sheet. Multisided polygonal shaped flux plates are able to be stamped from sheets that are no wider than the flux plates. Consequently, considerably less sheet material is needed to produce the equivalent number of multisided flux plates rather than circular flux plates.

The multisided flux plates, though more economical than circular flux plates, are just as efficient when used in connection with a circular annular permanent magnet. The multisided flux plate can be slightly smaller in area than a conventional circular flux plate but produce an equally strong magnetic field in the air gap when used with an annular permanent magnet.

BRIEF DESCRIPTION OF THE DRAWINGS

The invention will now be described with reference to the accompanying drawings in which.

DETAILED DESCRIPTION OF THE PREFERRED EMBODIMENT

Figure 1:
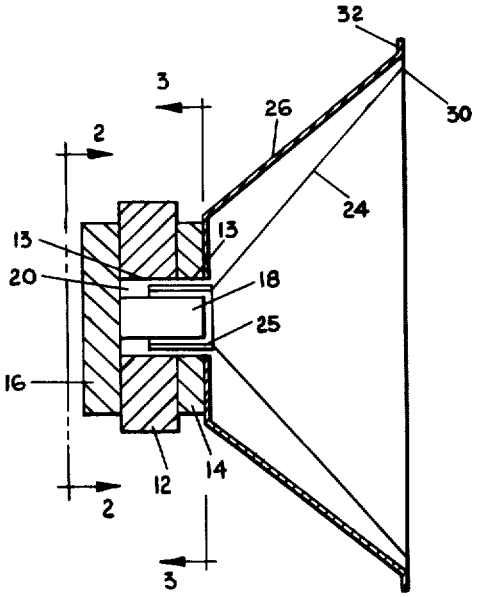
FIG. 1 is a cross-sectional view in section along an axis of an electroacoustical transducer constructed in accordance with the invention.
Figure 2:
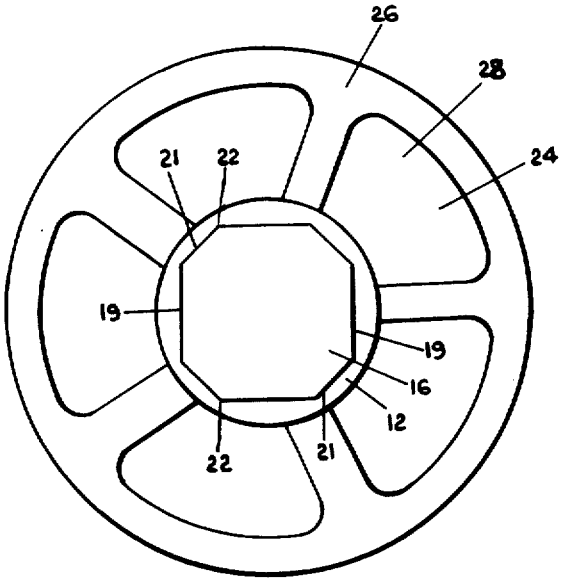
FIG. 2 is a plan view seen along line 2—2 of FIG. 1.
Figure 3:
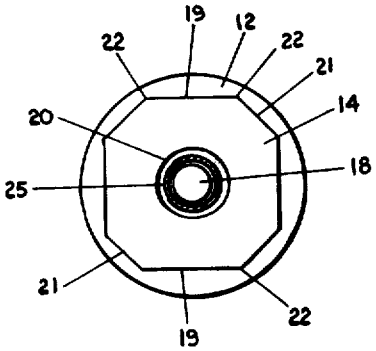
FIG. 3 is a cross-sectional view taken along line 3—3 of FIG. 1.

Referring to FIG. 1 of the drawings, an annular magnet 12 has a circular aperture 13 located in the center of said annular magnet 12. Attached to the back surface of the annular magnet 12, is a multisided back flux plate 16 with eight rectangular sides. One face of the flux plate 16 is completely flush with the annular magnet. The eight-sided back flux plate forms an irregular octagon with alternating sides of two lengths. Each side has an edge abutting the back surface of the annular magnet. Each side is perpendicular to the back surface of the annular magnet. The width of the back flux plate from two opposite long edges 19 is about 80 to 85 percent of the diameter of the circular annular magnet 12. The length from two opposite short edges 21 of the back flux plate is about 85 to 95 percent of the diameter of the annular magnet 12. With the length from the two opposite short edges 21 being approximately 95 percent of the diameter of the annular magnet 12, the corners 22 of the irregular octagon would coincide with the edge of the annular magnet 12. With the length from the two opposite short edges 21 being 91 percent of the diameter of the annular magnet 12, the appearance of the octagon is more regular in shape. With the width from two opposite long edges 19 being 81.5 percent of the diameter of the magnet and the length from two opposite short edges 21 being 91 percent of the diameter of the magnet, the surface of the back flux plate would cover approximately 77 percent of the surface area bounded by the outer diameter of the annular magnet 12. On the front surface of the annular magnet 12, is attached a front flux plate 14. One face of the flux plate 14 is completely flush with the annular magnet. The front flux plate 14 has the same shape as the back flux plate 16 but has an aperture 13 through its center aligned with the aperture 20 of the annular magnet 12. The front flux plate 14 is positioned so it is congruent with the back flux plate 16.

Figure 4:
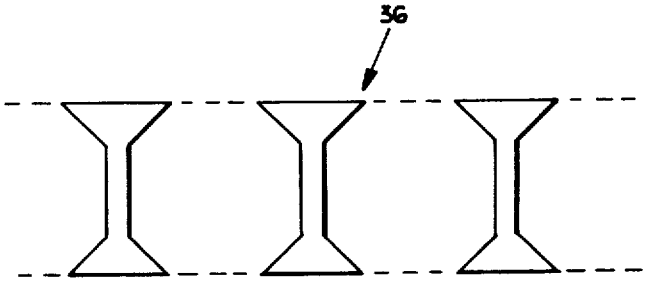
FIG. 4 is a plan view of the wasted sheet material from which the octagonal flux plates were pressed by a shearing process.
Figure 5:
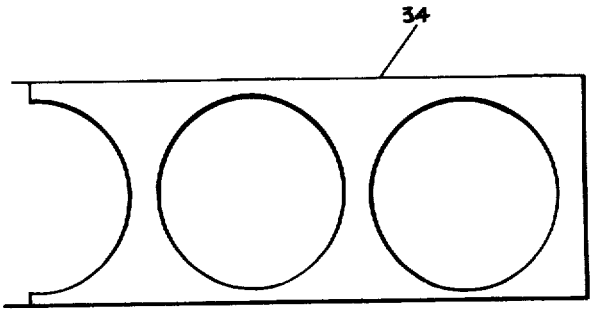
FIG. 5 (PRIOR ART)
FIG. 5 is a plan view of a prior art wasted sheet of material from which conventional circular flux plates were stamped.
Figure 6:
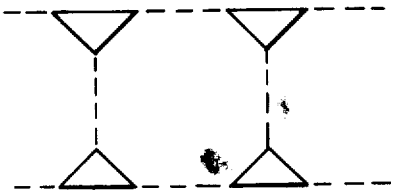
FIG. 6 is a plan view of the wasted sheet material from which the octagonal flux plates were formed by a notch and parting process.

The flux plates 14 and 16 are shaped octagonally to provide economy in manufacturing while not decreasing the efficiency of the electroacoustic transducer. When the width of the flux plates 14 and 16 is 81.5 percent of the width of the diameter of the annular magnet 12, a 32 percent saving of wasted material due to the manufacturing process of the flux plates results. The comparative wastes in manufacturing the multisided flux plates and conventional circular flow plates are shown in FIGS. 4, 5 and 6. FIG. 4 shows wasted material from metal sheet 36 from which octagonal flux plates were stamped by a shearing process. FIG. 5 shows another metal sheet of waste material 34 from which conventional circular flux plates were stamped. Most of savings in waste result from the fact that when circular flux plates are stamped the sheet 34 needs to be wider than the diameter of the circle by twice the thickness of the sheet. In contrast, when an octogonal shaped flux plate is sheared, the sheet need be no wider than the flux plate itself. The leeway in the width of the sheet is not required which consequently produces less waste and less expense. A second savings in waste result from the fact that circular plates have to be greater in diameter than the width of an equally sized multisided plate. Hence, a narrower strip of metal sheet is needed for a multisided flux plate even if circular flux plates could be stamped from a metal sheet equal in width to the diameter of the circular plate. Another savings in materials is the slight difference in size between the octagonal flux plates and conventional circular flux plates. The area bounded by the perimeter of the octagonal shaped flux plate is approximately 10% less than the area bounded by the conventional circular flux plates it replaces. Even more saving in waste material is possible if a notch and parting process is used to produce the octagonal flux plate as shown in FIG. 6.

Attached to the front surface of the back flux plate 16 is a pole piece 18 made from material capable of carrying magnetic flux like the annular magnet 12, the front flux plate 14 and the back flux plate 16. The pole piece is cylindrical in shape. It is approximately attached to the back flux plate 16 at one of its circular end surfaces. The cylindrical pole piece 18 fits within the apertures 13 and 20 of the annular magnet 12 and the front flux plate 14. It is fitted within the apertures 13 and 20 so as to leave an air gap 20 between it and the annular magnet 12 and front flux plate 14.

Within the air gap and around the cylindrical pole piece 18 is inserted a voice coil 25 made from material such as copper that is easily conducive to an electrical current.

A metal speaker housing 26 with air spacings 28 is rigidly attached to the front flux plate 14. The voice coil 25 is free to move within the air gap in a coaxial direction with respect to the cylindrical pole piece 18. The voice coil 25 is then operatively attached to a diaphragm 24. The outer end 30 of the diaphragm 24 is fixed to the outer end 32 of the metal speaker housing 26.

As described herein, a loud speaker can be made more economically and having no loss in efficiency by having multisided flux plates attached to both sides of an annular magnet.

It should be understood that the foregoing embodiment of the present invention is merely illustrative of the preferred practice of the present invention. While it is preferred that the area of the flux plates is 75–80 percent of the area bounded by the outer diameter of the annular magnet, it is foreseen that flux plates of varying sizes from 70–91 percent of the area bounded by the outer diameter of the annular magnet can be used and that various other changes and modifications may be made in the arrangements and details of construction of the embodiments described herein without departing from the spirit and scope of the present invention.

The embodiments of the invention in which an exclusive property or privilege is claimed are defined as follows:

1. In an electroacoustical transducer having an annular permanent magnet with a center aperture, a pole piece positioned in the aperture, a voice coil surrounding the pole piece, a diaphragm operatively connected to the pole piece, a front flux plate with a center aperture aligned with the aperture of the magnet, a back flux plate attached to the pole piece, the improvement comprising:

at least one of said flux plates having opposite parallel faces, one of which is completely flush with the annular magnet and said one flux plate having at least five sides substantially perpendicular to and between the faces, each side having an inner edge abutting the annular magnet, an outer edge substantially parallel to the inner edge, and two edges in common with adjacent sides; and the inner face edges of the one flux plate being contained within the area bounded by the outer diameter of the annular magnet.

2. An electroacoustical transducer as described in claim 1 wherein:

the inner face edges of the one flux plate define an area of 70–91 percent of the surface area defined by the outer diameter of the annular magnet.

3. An electroacoustical transducer as described in claim 2 wherein:

the one flux plate has a short diameter equal to 80–85 percent of the outer diameter of the annular magnet;

the one flux plate has a longer diameter equal to 85–95 percent of the outer diameter of the annular magnet.

4. An electroacoustical transducer as described in claim 3 wherein:

the inner face edges of the one flux plate form an irregular octagon with eight edges, four edges being of one length, four other edges being a shorter length alternately disposed between the four edges of longer length.

5. An electroacoustical transducer as described in claim 4 wherein:

the one flux plate's side edges define an area of 75–80 percent of the surface area defined by the outer diameter of the annular magnet.

6. An electroacoustical transducer as described in claim 1 wherein both flux plates have at least five sides and have their inner edges contained within the area bounded by the outer diameter of the annular magnet.

7. An electroacoustical transducer as described in claim 6 wherein the inner face edges of the flux plates form an irregular octagon with eight edges, four edges being of one length, four other edges being a shorter length and disposed alternately between the four edges of longer length.

8. An electroacoustical transducer as described in claim 7 wherein the flux plate's side edges define an area of 70–91 percent of the surface area defined by the outer diameter of the annular magnet.

9. An electroacoustical transducer as described in claim 8 wherein the flux plate's side edges define an area of 75–80 percent of the surface area defined by the outer diameter of the annular magnet.

10. An electroacoustical transducer as described in claim 8 wherein the edges of the front flux plate are parallel and aligned with corresponding edges of the back flux plate.

11. An electroacoustical transducer as described in claim 1 wherein:

each of the flux plates has opposite parallel faces, one face of each flux plate being completely flush with the annular magnet; each flux plate has eight rectangular sides substantially perpendicular to and between the faces of the respective flux plate; each side has an inner edge abutting the annular magnet, an outer edge parallel to the inner edge, and two edges in common with adjacent sides, each common edge being perpendicular to the plane defined by the flush face of the flux plate;

the face edges of the flux plate form irregular octagons with eight edges, four edges being of one length, four other edges being a shorter length alternately disposed between four edges of the longer length;

the inner face edges of the flux plate define an area of 75–80 percent of the surface area defined by the outer diameter of the annular magnet;

the flux plate has a short diameter equal to 80–85 percent of the outer diameter of the annular magnet; and the flux plate has a longer diameter equal to 85–95 percent of outer diameter of the annular magnet.

* * * * *